US005707505A

United States Patent [19]

Huss

[11] Patent Number: 5,707,505

[45] Date of Patent: Jan. 13, 1998

[54] METHOD FOR THE ELECTROPHORETIC DIP COATING OF CHROMATIZABLE METAL SURFACES

[75] Inventor: Rainer Huss, Kempten, Germany

[73] Assignee: Gesellschaft für Technische Studien Entwicklung Planung mbH, Munich, Germany

[21] Appl. No.: 314,612

[22] Filed: Sep. 28, 1994

Related U.S. Application Data

[63] Continuation of Ser. No. 158,165, Nov. 24, 1993, abandoned, which is a continuation of Ser. No. 29,926, Mar. 11, 1993, abandoned, which is a continuation of Ser. No. 758,527, Sep. 19, 1991, abandoned, which is a continuation of Ser. No. 414,761, Sep. 29, 1989, abandoned.

[30] Foreign Application Priority Data

Sep. 29, 1988 [DE] Germany ..... 38 33 119.5

[51] Int. Cl.[6] ..... C25D 13/12

[52] U.S. Cl. ..... 204/486; 204/499; 148/264; 148/267

[58] Field of Search ..... 204/484, 486, 204/499, 510; 148/264, 265, 267

[56] References Cited

U.S. PATENT DOCUMENTS

| | | | |
|---|---|---|---|
| 2,559,878 | 7/1951 | Johnson | 148/6.21 |
| 2,800,438 | 7/1957 | Stareck | 204/41 |
| 3,113,845 | 12/1963 | Uchida | 204/34 |
| 3,397,091 | 8/1968 | Russel | 148/265 |
| 3,501,278 | 3/1970 | Uchida et al. | 204/181.1 |
| 3,558,460 | 1/1971 | Uchida | 204/181.1 |
| 3,574,069 | 4/1971 | Roberts | 204/41 |
| 3,808,057 | 4/1974 | Labenski et al. | 204/55.1 |
| 3,963,527 | 6/1976 | Lindemann | 106/1.25 |
| 4,165,242 | 8/1979 | Kelly et al. | 204/181.1 |
| 4,171,231 | 10/1979 | Bishop et al. | 148/266 |
| 4,315,053 | 2/1982 | Poth | 525/443 |
| 4,724,254 | 2/1988 | Geist | 525/523 |
| 4,882,090 | 11/1989 | Batzill | 524/495 |
| 4,971,636 | 11/1990 | Watanabe et al. | 148/265 |
| 5,011,733 | 4/1991 | Hiraki et al. | 204/486 |

FOREIGN PATENT DOCUMENTS

| | | | |
|---|---|---|---|
| 171643 | 9/1984 | Japan | 148/265 |

OTHER PUBLICATIONS

Lowenheim, "Electroplatine", McGraw–Hill Inc., pp. 442–444, 1978. (no month available).

*Primary Examiner*—Kathryn L. Gorgos
*Assistant Examiner*—Kishor Mayekar
*Attorney, Agent, or Firm*—Schweitzer Cornman Gross & Bondell LLP

[57] ABSTRACT

A method is described for the electrophoretic enamelling of chromatizable metal surfaces. Improved adhesion of the enamel is achieved by a chromating pretreatment of the metal surfaces, the chromated metal surfaces being kept wet from the time of their being chromated up to the time of their introduction into the bath for the electrophoretic enamelling.

11 Claims, No Drawings

METHOD FOR THE ELECTROPHORETIC DIP COATING OF CHROMATIZABLE METAL SURFACES

This is a continuing application of U.S. Ser. No. 08/158,165, filed on Nov. 24, 1993, which was a continuing application of U.S. Ser. No. 08/029,926, filed on Mar. 11, 1993, which was a continuing application of U.S. Ser. No. 07/758,527, filed on Sep. 6, 1991, which was a continuing application of U.S. Ser. No. 07/414,761, filed on Sep. 29, 1989, all now abandoned.

FIELD OF THE INVENTION

The invention relates to a method for the electrophoretic dip coating of chromatizable metal surface. Chromatizable metal surfaces are, primarily the surfaces of the metals zinc, cadmium, aluminum and magnesium, as well as of their chromatizable alloys. The method therefore also is suitable for the electrophoretic dip coating of iron and steel surfaces, which are coated with such metals or their alloys, for enamelling of galvanized iron and steel surfaces.

BACKGROUND OF THE INFORMATION AND PRIOR ART

Metal surfaces are enamelled not only for decorative purposes—corrosion protection frequently is the main reason, especially when iron and steel parts are enamelled. Very good protection against corrosion is achieved by enamelling iron and steel parts, provided that the enamel forms a gap-free coating. If, however, the layer of enamel has pores, holes, cracks or similar defects due to damage, ageing processes or defective production of the enamelled layer, there is rapid development of corrosion, which starts out from these defects, and a cauliflower-like lifting off of the layer of enamel, under which the corrosion process has migrated ("cauliflower" corrosion and filiform corrosion). This damage due to corrosion is thus not limited to the site of the defect in the enamel layer, but spreads rapidly.

Corrosion protection, which is retained even when the protective layer has been damaged slightly, can also be achieved by galvanizing. Excellent protection against corrosion is achieved by hot galvanizing steel parts because of the thick layer of zinc of typically 50 to 200 microns together with the iron-zinc alloy as transition layer from the zinc to the surface of the steel base material.

A zinc layer of lesser thickness is adequate when deposited by electrogalvanizing. Moreover, electrogalvanized sheet steel does not have brittle intermediate layers of iron-zinc alloys. Electrogalvanizing make possible the cathodic corrosion protection of the steel as the sole, relatively inexpensive method, which leads to the electrochemical suppression of the corrosion of the steel by the zinc layer, even in the case of craters up to about 0.7 mm wide.

In view of its slight thickness (averaging 10 microns), the layer of zinc, which is applied as sole protection for the steel during the electrogalvanizing process, is however a completely inadequate protection against corrosion. This is so especially for the glossy, smooth layers. These are not even resistant to handling. The corrosion protection, as determined by the Salt Spray Test of DIN 50021, is only minimal; the zinc layer has corroded away and brown rust has appeared after only about 6 to 8 hours.

A distinct improvement in corrosion protection can be achieved by chromating or phosphating the zinc surface. Times of 24 hours before the appearance of the first white rust in the Salt Spray Test are customary for blue chromatings and times of about 200 hours for yellow chromatings.

Phosphating on electrogalvanized zinc coatings also increases corrosion protection. However, these surfaces are rough and, if damaged, do not show the self-healing mechanism that is known from chromatings. Phosphatings are therefore used only as a wash primer for subsequent enameling. In the Salt Spray Test, these layers are corrosion resistant up to about 150 hours.

However, these value are valid only for parts with smooth walls and not for critical sites, as represented by re-entering angles (such as depressions, blind holes, threads). Because of electrical field effects, frequently not enough zinc is deposited in these regions to achieve good corrosion protection.

The protective effect of chromating can be increased by re-immersing freshly chromated parts in special, aqueous, so-called sealing solutions. This improvement is clearly reflected in the Salt Spray Test. In a similar manner, in the method disclosed in the German Auslegeschrift 2,046,449 for the protection of corrosion endangered parts that are relevant to safety, such as brake linings, electrogalvanized metal parts are chromated, rinsed and then, while still wet from the rinsing, immersed in a dispersion of synthetic materials, an elastic, intimately interlocked composite layer of uneven thickness of chromating and synthetic material being obtained, which provides good protection against corrosion.

The German Auslegeschrift 1,521,656 discloses the chromating of zinc and zinc alloys. After being rinsed and subsequently air dried, the chromated metal surfaces can be provided with a drying paint based on so-called drying oils (unsaturated fatty acids), which cross link with absorption of oxygen from the air.

For reasons of protecting the environment, water-dilutable enamel, especially electrophoretic enamel, is used for the combination of electrogalvanizing and subsequently pore-free enamelling in large plants (for example, in the automobile industry).

Electrophoretic enamelling is particularly suitable, since uniformly thick layers result from this method, so that high requirements for the dimensional accuracy of the enamelled pats can be fulfilled. In contrast to the galvanic deposition of metals, critical hollow spaces, such as blind holes or the inner walls of pipes are also enamelled throughout. These inaccessible sites usually are well protected against damage by external influences. An electrophoretic dip coating of electrogalvanized steel parts can therefore lead to a significant improvement in corrosion protection. With this combination, however, the adhesion between zinc and the organic, built-up enamels is a major problem. It has turned out that, under the influence of weathering and/or mechanical stresses, the enamel can peel off within a short time. Priming or adhesion promotion therefore is required for the application of the enamel. Adhesion promotion is also required in every case, where metals with properties similar to those of zinc, such as cadmium or aluminum, are to be enamelled. An adhesion promoter also is frequently used with steel.

In the case of base metals such as steel, zinc (as a pressure die casting or when applied as a layer, for example, on steel), cadmium (when applied as a layer), aluminum (or its alloys) and magnesium (or its alloys), the adhesion promotion usually consists of a phosphating.

However, the phosphating method has some serious disadvantages:

The whole procedure of adhesion promotion by means of phosphating is rather extensive:

activation (seeding with $TiO_2$ particles, in order to obtain fine grained, uniform phosphated layers)
phosphating; rinsing
dipping in chromic acid, rinsing.

It therefore requires a corresponding investment in equipment and leads to long processing times; in addition the chemicals used are expensive.

The phosphating solution must be filtered constantly, in order to remove precipitated, insoluble tertiary phosphate; this would otherwise interfere with the phosphating process.

The concentration of the phosphating solution of 100 to 200 g/L of phosphating salt is very high; this requires a considerable expense for rinsing after the phosphating. The filtration as well as the rinsing lead to a considerable accumulation of phosphate-containing sludge. Because of its heavy metal content, this must be disposed of as hazardous waste.

The analysis of the phosphating solution is expensive and can be automated only with difficulty; however, to ensure a constant quality during continuous operation, the method should be automated.

Until now, those skilled in the art had to assume that adhesion promotion for electrophoretic enamelling by chromating is not possible. If namely metal surfaces, which are provided, for example, with chromated connectors such as screws, are enamelled by electrophoretic enamelling, defective adhesion or flaking of the enamel is observed, as is described, for example, in "Galvanotechnik" 80 (1989), pages 1615–1621 and in "Versiegelung und Lackierung von galvanisch verzinkten Oberflaechen" (Sealing and Enamelling Electrogalvanized Surfaces), paper presented at the conference on Feb. 21 and 22, 1989, of the Deutsche Forschungagesellschaft fuer Oberflaechenbehandlung e.V. (DFO—German Research Society for Surface Treatment), together with the deutschen Gesellschaft fuer Galvano—und Oberflaechentechnik e.V. (DGO—German Society for Galvanic and Surface Technology) pages 143–153.

OBJECT OF THE INVENTION

It is an object of the invention to provide a method, by means of which electrophoretic enamels can be deposited on chromatizable metal surfaces with a significantly better adhesion that achievable with methods of the state of the art and by means of which the aforementioned disadvantages of phosphating to promote adhesion can be avoided.

SUMMARY OF THE INVENTION

Pursuant to the invention, this objective is accomplished by a method for the electrophoretic enamelling of chromatizable metal surfaces, which is characterized in that the metal surfaces are pretreated by chromating and the chromated metal surfaces are kept wet from the time of the chromating process until they are introduced into the bath for the electrophoretic enamelling. Keeping wet is understood to mean that the aqueously wet chromated metal surface, obtained after the chromating process, is kept under such conditions until the electrophoretic enamelling process, that no drying can take place. As used herein, the term "chromatizable metal" refers to a metal other than iron and steel, but one that is known as being readily chromatizable by a chemical deposition, as contrasted to any electrolytic deposition process, such as zinc, cadmium, aluminum, magnesium, or chromatizable alloys thereof, also including base metals such as iron and steel when coated with a chromatizable metal.

Surprisingly, it has been ascertained within the scope of the invention that chromating layers can be used as adhesion promoters for electrophoretic enamels, provided that these layers are kept in the wet state after they are prepared until they are electrophoretically enamelled. Within the scope of the invention, it has been ascertained that freshly prepared, still wet chromating layers have a hydrophilic surface, which is suitable for electrophoretic enamelling. This suitability is retained if the freshly prepared chromating layers are kept wet or stored moist until they are enamelled electrophoretically. However, after the chromated surfaces have dried, electrophoretic enamels can be deposited only with poor adhesion. It was also observed that, after drying, renewed wetting with water of the chromating surface, once it has dried, does not lead to any improvement in the adhesion of the coating materials applied by electrophoretic enamelling. This is the state of affairs for all chromating layers, which are applied by conventional methods, such as yellow, blue, transparent and other chromating layers.

Pursuant to the invention, the metal surface is chromated as adhesive base before the electrophoretic enamelling. In contrast to the previously used phosphating, such a chromating has a smooth glossy surface. If the chromated surface is kept wet pursuant to the invention, the surface has such a high surface tension that, upon being wetted with water, a contact angle of the order of 0° results at the interface, that is, at the edge of the water droplet. If there is drying, this contact angle is increased greatly, for example to 20° to 50°, and indicates poor wettability.

The qualitatively high-grade deposition of the electrophoretic enamel on the chromating layer can be assured owing to the fact that the deposition of the enamel takes place immediately after the chromating without any intermediate drying.

The qualitative high-grade deposition of the electrophoretic enamel on the chromating layer can furthermore be assured owing to the fact that, until the start of the electrophoretic deposition, the deposited enamel is constantly kept moist by being sprayed with water or stored in air with a very high relative humidity. Spraying with water comes into consideration especially when the whole of the surface can be sprayed. The height of the relative humidity, which is required to prevent a drying out of the surface of the chromating layers, depends on the time period, which must be bridged until the start of the deposition of the enamel. A high relative humidity is understood to be one, which is required so that no water can evaporate from the chromated surface and any drying out is prevented. It depends on the time period, which must be bridged up to the start of the deposition of the enamel. In general, it can be assumed that the relative humidity must be greater than 90%; for prolonged storage, it may amount up to 100%.

On the other hand, storage of the fresh layers under water until the start of the electrophoretic enamelling is less preferred, since components of the chromating (especially chromate ions) can go into solution and there may be so-called bleeding from the chromating layer.

An improvement in the adhesion of coatings deposited by electrophoretic enameling on surfaces of chromatizable metals can be achieved by the inventive method. Such metals, are, for example, zinc, cadmium, aluminum, magnesium and their chromatizable alloys. The inventive method thus is suitable for iron and steel surfaces, such as sheet metal, which has been coated with such chromatizable metals as zinc.

The chromating of the metal surfaces takes place in the usual manner familiar to those skilled in the art. Any known chromating method can be used, for example, that described by T. W. Jelinek in "Galvanisches Verzinken" (Electrogalvanizing), published by Leuze in 1982.

Chromating preferably is accomplished with a chromating solution, which consists only of inorganic components. Such a chromating solution has, for example a concentration of 1 to 10 g/L of chromic acid ($H_2CrO_4$) and particularly of 4 g/L of chromic acid at a pH of 0 to 3 and preferably of 2.3 to 2.7. It is advantageous but not essential if the chromating solution contains one or several salts of the metal that is to be chromated. Examples of such salts are chlorides, nitrates and/or fluorides. The concentration of such optionally present salts is, for example, of the order of 0.001 to 0.1 moles/L and preferably of the order of 0.05 moles/L. The pH of a freshly prepared chromating solution can be adjusted, for example with an oxide or hydroxide of the metal to be chromated. It can be checked during the operation by measurement with, for example, a glass electrode or by conductivity measurement and adjusted once more to the desired value by the addition of acid or oxide or hydroxide.

The usual chromatings represents the last layer, the so-called finish for chromatizable metals and are optimized for this purpose, that is, they offer some protection against corrosion (in the case of zinc: yellow and olive chromating) or improve the appearance (in the case of zinc: blue and black chromating). Other aspects, such as the effect on the environment, a long lifetime, the ability to regenerate, etc., which do not directly affect the quality of the chromating layer, are given hardly any attention at the present time.

In the inventive method, on the other hand, chromating is required only to promote adhesion. The requirements with respect to appearance and, partly also, with respect to corrosion protection are fulfilled from the enamel or by tie combination of galvanically deposited zinc layer and enamel layer.

Any conventional chromating method, which guarantees chromating baths that have a long lifetime, can be regenerated easily and have a low consumption of chemicals, are therefore particularly suitable of the inventive method.

For example, chromating solutions, which contain only inorganic components, are particularly suitable, since they can be regenerated by the method known from the German Patent 3,138,503. According to the teachings of the German Patent 3,138,503 interfering decomposition products are removed from the chromating solutions with the help of ion exchangers, electrodialysis, electrolysis or chemical oxidation, the pH or the conductivity is measured during the operation, the $Cr^{6+}$ and $Cr^{3+}$ concentrations are determined photometrically and make-up solutions are added depending on these analytical values and the flow through the ion exchangers or the fractionating, exchange or reaction apparatuses is controlled in such a manner, that the composition of the chromating solution is kept within a specified range of concentrations. Chromating solutions of very low concentration are sufficient to promote the adhesion between galvanically deposited zinc and the electrophoretic enamel. Because chromating solution is carried out of the chromating bath together with the chromated metal parts, the concentration of unwanted decomposition products in the chromating solution cannot increase to interfering values. A removal of the unwanted decomposition products, as provided for in the German Patent 3,138,503 with the help of, for example, ion exchangers, can therefore be omitted; it is sufficient to compensate for the chromating solution carried out.

Pursuant to the invention, the known chromating methods, which work without hexavalent chromium, that is, in the absence of chromate, can also be used. These methods are also familiar to those skilled in the art and are described, for example, in the aforementioned book by T. W. Jelinek. Admittedly, such chromatings are not very suitable for corrosion protection; however, they do promote adhesion well and have the advantage, that the baths used are not an environmental hazard, since they do not contain any hexavalent chromium. Such baths containing chromium(III) salts, such as potassium chromium sulfate; they may contain acids, such as nitric acid and salts, such as fluorides, for example, ammonium hydrogen fluoride.

All conventional chromating methods are suitable for the inventive method. In the Federal Republic of Germany, chromating methods are standardized according to the regulations of DIN 50960, Pat 1. One differentiates between colorless chromating, blue chromating, yellow chromating, olive chromating and black chromating. These chromating methods are suitable, for example, for the inventive method. According to T. W. Jelinek, "Galvanishes Verzinken" (Electrogalvanizing), published by Leuze in 1982, page 140, layers up to 0.01 microns thick and weighing 0.03 mg/dm$^2$ are attained for colorless chromating, layers up to 0.08 microns thick and weighing 0.5–5 mg/dm$^2$ are attained for blue chromating, layers up to 1 micron thick and weighing 5–20 mg/dm$^2$ are attained for yellow chromating and layers 1.25 microns thick and weighing 20 mg/dm$^2$ are obtained for olive chromating. All of these thicknesses (which relate in the given state in each case to the thicknesses of the dry layers) are suitable for the inventive method, for which it is sufficient to form the colorless or blue chromatings, which normally are used for decorative purposes, but not for corrosion protection.

Rinsing with water to remove excess chromating solution directly after the chromating process may be advantageous. Whether such a rinsing process is carried out depends on the concentrations of the chemical compounds and ions used in the chromating solution, as well as on the way in which the method is carried out. In the case of an electrophoretic deposition of enamel, the number of ions carried over into the enamel bath should be kept as low as possible. If the chromated metal parts are to brought without delay into the bath for electrophoretic enameling, a rinsing process before the electrophoretic enamelling may be particularly advantageous, irrespective of the composition of the chromating solution used. On the other had, if the chromated metal parts are kept wet by being sprayed with water until they are brought into the bath for electrophoretic enamelling, an additional rinsing process can be omitted if the composition of the chromating solution is suitable.

The metal surfaces, pretreated pursuant to the invention by chromating and being kept wet, can be coated or enamelled by the conventional electrophoretic enamelling. All conventional electrophoretic coating materials and enamelling methods, which with those skilled in the art are familiar, are suitable. There are no particular limitations with respect to the coating materials or electrophoretic enamelling methods that can be used. Of the two basic possibilities of electrophoretic enamelling, namely anaphoresis and cataphoresis, the latter, that is the cataphoretic enamelling is particularly preferred for the inventive method. However, anodic deposition (anaphoresis) is also suitable.

The enamel layers, prepared by the inventive method, are glossy, smooth and free of pores and provide excellent protection against corrosion. These enamel layers can serve, for example, as primers, which can be processed further in a conventional manner with filling enamels and covering enamels.

An example of the treatment of galvanized sheet steel by the inventive method is given in the following.

EXAMPLE

Sheet steel was treated by the following process steps:

Defatting (with solvent or aqueous alkaline); rinsing

Pickling (with nitrosulfuric acid or sulfuric acid); rinsing

Electrolytic defatting; rinsing

Electrogalvanizing (cyanidic, alkaline or acidic); rinsing

Brightening (10 seconds; 3 g/L of nitric acid); rinsing may be omitted

Chromating (1–3 min); rinse; do not dry

Cataphoretic enamelling with a conventional, commercial, electrophoretic enamelling bath, rinsing with water Drying, stoving For this example, the chromating bath has the following composition:

1–5 g/L $H_2CrO_4$

2–10 g/L $Zn(NO_3)_2$ pH approximately 2.5, adjusted with ZnO or NaOH

The chromating layer is almost transparent and leads to very good adhesion of the enamel layer. The enamel layer, is glossy, smooth, flat, free of pores and provides good protection against corrosion.

The chromating solution shows no signs of autodecomposition. Moreover, since the dissolution of zinc (and iron at the regions not galvanized) is very slight during the chromating process, the decomposition products do not accumulate to a concentration that interferes; a purification of the solution by means of a cation exchanger thus is unnecessary. For a continuous operation, it is advisable to replace the bath components, which are carried Out, continuously and to keep the pH constant (by means of analysis or fully automatic and continuously as disclosed in German patent 3,138,503).

EXAMPLE OF A CHROMATE-FREE CHROMATING SOLUTION

Ammonium hydrogen fluoride $(NH_4)HF_2$ 2.0 g/L

Nitric acid 4.0

Potassium chromium sulfate $KCr(SO_4)_2 \times 12H_2O$ 3.0 g/L

I claim:

1. A process for electrophoretic enameling of zinc or cadmium plated chromatizable metal surfaces, which comprises chromatizing the plated surface with a chromatizing solution by a chemical treatment, then cataphoretically enameling said chromatized surface, wherein said chromatized surface is maintained wet between said chromatizing and said enameling.

2. The process of claim 1, wherein said maintaining wet comprises at least one of (i) spraying said chromatized surface with water, and (ii) keeping the chromatized surface under high humidity.

3. The process of claim 1, further comprises rinsing with water the chromatized surface immediately upon completion of said chromatizing.

4. The process of claim 1, wherein said chromatizing is carried out with a solution containing only inorganic ingredients.

5. The process of claim 4, wherein the chromatizing solution is an aqueous solution of chromic acid.

6. The process of claim 5, wherein said chromatizing solution further contains a stilt of the metal that is chromatized.

7. The process of claim 5, wherein said chromatizing solution contains less than 10 g/L $H_2CrO_4$.

8. The process of claim 6, wherein said chromatizing solution contains less than 10 g/L $H_2CrO_4$, and less than 0.1 moles of said salt.

9. The process of claim 1, wherein said chromatizing solution is free of hexavalent chromium ions.

10. The process of claim 9, further comprises replenishing only said chromatizing solution by adding thereto a makeup solution comprising substantially concentrated chromic acid.

11. The process of claim 10, wherein said makeup solution is a first makeup solution, and said chromatizing solution is also replenished by a second makeup solution together with or separately from said first makeup solution, said second makeup solution contains one or more of hydrochloric acid, nitric acid, and hydrofluoric acid, and a nitrate or a fluoride of the chromatizable metal of said surface.

* * * * *